US005360295A

United States Patent [19]

Isacksen

[11] Patent Number: 5,360,295

[45] Date of Patent: Nov. 1, 1994

[54] PLASTIC SHEATH FOR WOOD BULKHEADS

[76] Inventor: Jeffrey D. Isacksen, 28 Astor Ave., Brookhaven, N.Y. 11719

[21] Appl. No.: 111,985

[22] Filed: Aug. 26, 1993

[51] Int. Cl.[5] ..... E02D 29/02; E02B 3/06

[52] U.S. Cl. ..... 405/284; 405/31; 405/272; 405/274

[58] Field of Search ..... 405/31, 262, 274, 275, 405/276, 284

[56] References Cited

U.S. PATENT DOCUMENTS 1,483,825 2/1924 Martinez ..... 405/274
1,902,397 3/1933 Doyle ..... 405/274
4,690,588 9/1987 Berger ..... 405/274 X

FOREIGN PATENT DOCUMENTS 40415 3/1985 Japan ..... 405/275
290516 12/1991 Japan ..... 405/274

*Primary Examiner*—David H. Corbin
*Attorney, Agent, or Firm*—Galgano & Burke

[57] ABSTRACT

A plastic sheath for wood bulkheads and the like which includes an elongated plastic sleeve configured and dimensioned to cover at least three sides of a generally rectangular wood board and at least the marginal edge of the remaining side thereof. The sleeve has a front panel covering a front side of the wood board, two side panels each joined to the front panel for covering opposite side edges of the wood board and at least two rear flaps each joined to an opposite one of the opposite side panels for covering at least the marginal edge of a rear side of the wood board. One of the side panels has a generally centrally disposed tongue and the other of the side panels has a generally centrally disposed groove for joining a multiplicity of so-sheathed boards together in a tongue-and-groove manner.

6 Claims, 1 Drawing Sheet

PLASTIC SHEATH FOR WOOD BULKHEADS

BACKGROUND OF THE INVENTION

The present invention relates to a plastic sheath for lumber, especially treated lumber, used for bulkheads and the like. More particularly, it relates to such a plastic sheath which affords a tongue-and-groove interconnection of adjacent sheathed boards.

Marine bulkheading is commonly made of wood which is chemically treated and milled to provide a tongue-and-groove connection for adjacent boards. Notwithstanding the chemical treatment, the wooden bulkhead is typically destroyed over time Marine "borers" e.g., worms and other sea creatures, will attack the area ranging between the high water mark and the bottom of the bulkhead, causing the bulkhead to eventually fail. These borers even attack any type of "CCA" or chemically treated lumber.

In addition, various towns and other municipalities are considering banning the use of chemically treated lumber for bulkheading due to the potential hazard of leaching of hazardous chemicals into the water and the possible environmental hazard that this might cause.

Various proposals have been made to overcome these problems such as using solid plastic sheathing in place of the treated lumber. Presently, solid plastic sheathing is being produced at a cost that is prohibitive to the average person living on the water. It is mainly being used in municipal projects.

SUMMARY OF THE INVENTION

Accordingly, it is an object of the present invention to provide to a novel plastic sheath for wood bulkheads and the like which minimizes damage caused by biological attack thereon and which also minimizes the possibility of leaching of potentially hazardous chemicals into the water from the use of chemically treated lumber.

It is a more particular object of the present invention to provide such a novel plastic sheath which is of relatively simple design, economical to fabricate, easy and facile to use and install, and cost effective.

Certain of the foregoing and related objects are readily attained according to the present invention by the provision of a plastic sheath for wood bulkheads and the like which includes an elongated plastic sleeve configured and dimensioned to cover at least three sides of a generally rectangular wood board and at least the marginal edge of the remaining side thereof. The sleeve has a front panel covering a front side of the wood board, two side panels each joined to the front panel for covering opposite side edges of the wood board and at least two rear flaps each joined to an opposite one of the opposite side panels for covering at least the marginal edge of a rear side of the wood board. One of the side panels has a generally centrally disposed tongue and the other of the side panels has a generally centrally disposed groove for joining a multiplicity of so-sheathed boards together in a tongue-and-groove manner.

In the preferred embodiment of the invention, the rear flaps are part of a rear panel integrally formed with the sleeve which covers the entire rear side of the wood board. Most desirably, the sheath additionally includes means for fastening the sleeve to a wood board. The means for fastening preferably comprises nails for nailing the rear flaps to the wood board.

BRIEF DESCRIPTION OF THE DRAWINGS

Other objects and features of the present invention will become apparent from the following detailed description considered in connection with the accompanying drawings which disclose two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figures 1, 2, 3, 4:
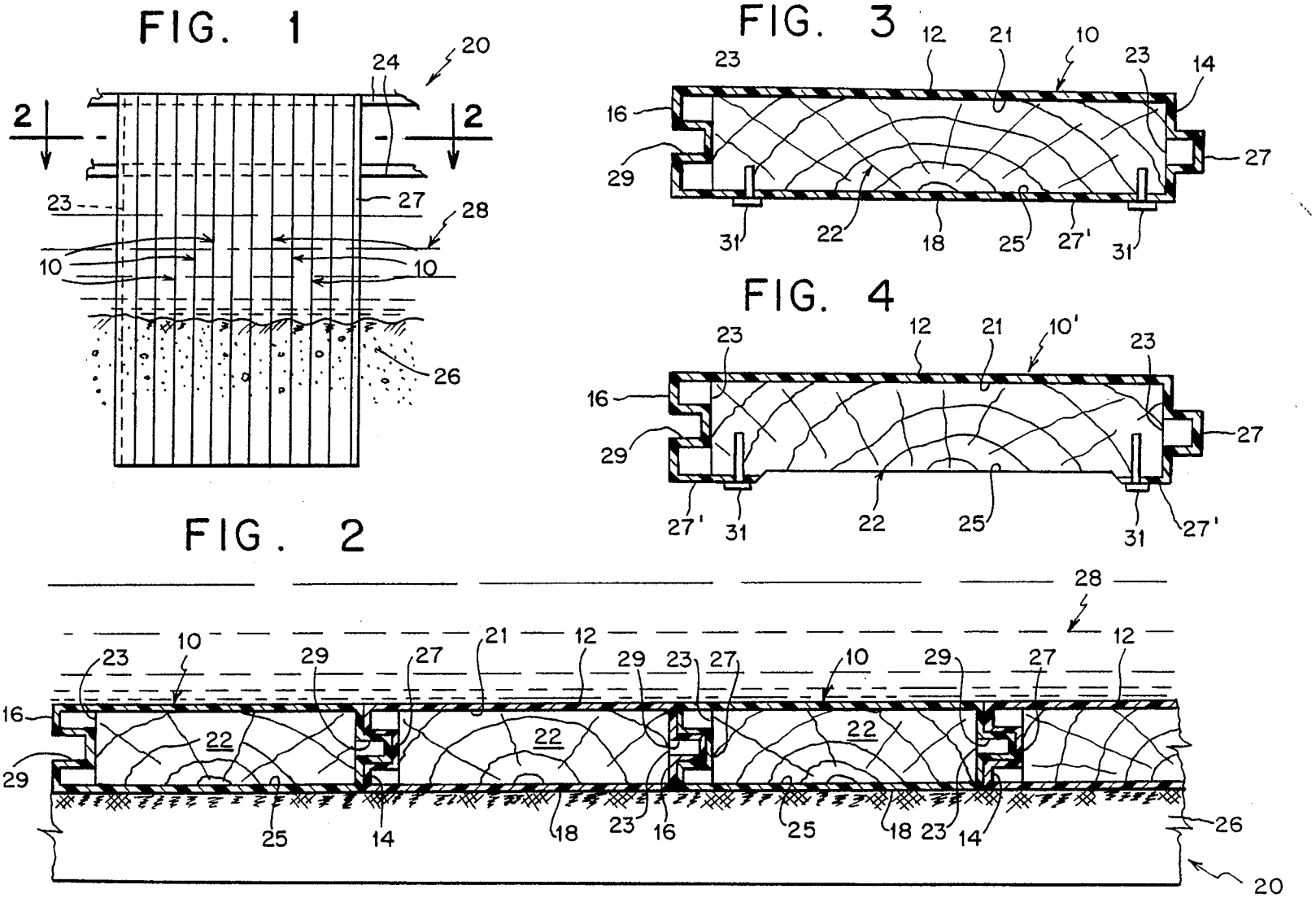
FIG. 1 is a side elevational view showing the present invention installed on a marine bulkhead.
FIG. 2 is a sectional view taken along line 2—2 of FIG. 1.
FIG. 3 is a cross-sectional view similar to that of FIG. 2 showing a single sleeve covering a single wood board.
FIG. 4 is a cross-sectional view of an alternate embodiment of the present invention covering a single wood board.

Turning now in detail to the present invention and, in particular, FIG. 1 thereof, therein illustrated is a novel plastic sheath embodying the present invention, generally designated by reference number 10 which is used to protect bulkheads 20 and the like. Bulkhead 20 consists of a series of vertically disposed, chemically treated rectangular wood boards or planks 22 which are conventionally joined together by tongue-and-groove connections and are nailed to a pair of vertically spaced apart 6"×6" walers 24, the lower one of which is approximately at the mean low water line. The lower end of the boards 22 are embedded in the ground or seabed 26 of the body of water 28.

As seen best in FIG. 2 and 3, each of the rectangular wood planks 22 is covered by a plastic sheath 10 consisting of a front panel 12 which covers the front side or face 21 of the board, two side panels 14, 16 which cover the opposite side edges 23 of the board, and a rear panel 18 which covers the rear side 25 of the board. The side panel 14 has a centrally-disposed rectangular tongue 27, and the opposite side panel 16 has a centrally-disposed rectangular groove 29 which are suitably dimensioned so as to allow adjacent sheathed boards to be joined together in a tongue-and-groove manner similar to conventionally milled boards having tongue-and-groove connections. As shown in FIG. 3, the rear panel 18 of the sleeve 10 is affixed to the rear side 27 of the board 22 by nails 31 or the like so as to prevent the sleeve 10 from sliding or moving relative to the board 23.

FIG. 4 shows an alternate embodiment of the invention where instead of the employment of a completely encompassing, generally rectangular sleeve 10, a generally C-shaped sleeve 10' is provided also having a front panel 12 which covers the front side or face 21 of the board and two side panels 14, 16 which cover the opposite side edges 23 of the board. Here, too, the side panel 14 has a centrally-disposed rectangular tongue 27, and the opposite side panel 16 has a centrally-disposed rectangular groove 29 which are suitably dimensioned so as to also allow adjacent sheathed boards to be joined together in a tongue-and-groove manner. However, the side panels are connected to rear flaps 27' which only cover the peripheral marginal edges of the rear side 25 of the board 22. Flaps 27' are joined to the rear side 25 of the board by nails 31, as well. As can be appreciated, since this side of the board would normally be against the soil and not the water, it need not necessarily be covered since it would not be subject to attack by the marine borers.

The plastic sheathing sleeves of the present invention can be produced to accommodate various thicknesses of standard treated lumber. A typical piece of sheathing used in dock building has a dimension of two or three inches by ten inches but can be thicker and wider according to particular job specifications. It can be made of any type of suitable plastic material, (e.g. PVC), and its thickness can also be varied to suit the needs of a particular application.

As can be appreciated, by separating the treated lumber from contact with the water, no leaching of potentially hazardous chemicals will occur. It will be impossible for marine borers to attack the bulkhead through the plastic sleeves and, thus, the use of the plastic sleeves will also make the use of treated lumber and bulkheading environmentally safe.

Moreover, the conventional milling of tongue-and-groove sheathing from different mills can have variations making the interlocking of the wood boards almost impossible. The present invention allows the use of square-cut boards and standardized tongue-and-grooves on the plastic sleeves 10 which eliminates this problem and reduces the cost of the lumber, as the milling of the tongue-and-groove is not necessary. The plastic sheath of the present invention allows one to build and protect a bulkhead at far less cost and with the same life expectancy as solid plastic.

Accordingly, while only two embodiments of the present invention has been shown and described, it is to be understood that many changes and modifications may be made thereunto without departing from the spirit and scope of the invention as disclosed herein.

What is claimed is:

1. A plastic sheath for an in combination with wood bulkheads and the like, comprising:

an elongated plastic sleeve configured and dimensioned to cover at least three sides of a generally rectangular wood board having front and rear sides and a pair of side edges and at least the marginal edge of the remaining side thereof, said sleeve having a front panel covering the front side of the wood board, two side panels each joined to said front panel for covering opposite side edges of the wood board and at least two rear flaps each joined to an opposite one of said opposite side panels for covering at least the marginal edge of the rear side of the wood board, one of said side panels having a generally centrally disposed tongue and the other of said side panels having a generally centrally disposed groove for joining a multiplicity of sheathed boards together in a tongue-and-groove manner without forming tongues and grooves within said wood boards.

2. A plastic sheath according to claim 1, wherein said rear flaps are part of a rear panel integrally formed with said sleeve which covers the entire rear side of the wood board.

3. A plastic sheath according to claim 1, additionally including means for fastening said sleeve to a wood board.

4. A plastic sheath according to claim 1, wherein means for fastening comprises nails for nailing said rear flaps to the wood board.

5. A wooden bulkhead comprising:

a plurality of rectangular shaped wood boards, each of said boards comprising front and rear sides and a pair of side edges, lined up in a row with a side edge of each board facing a side edge of an adjacent board, and means for joining the adjacent wood boards in said bulkhead in a tongue-and-groove manner without having tongues and grooves in said boards, said means comprising an elongated plastic sleeve configured and dimensioned to cover at least three sides including two side edges of each of said wood boards and at least a portion of the remaining side thereof, each said sleeve having a front panel covering the front side of the wood board, two side panels each joined to said front panel for covering opposite side edges of the wood board and at least two rear flaps for covering said portion of the rear side of the wood board, one of said side panels having a generally centrally disposed tongue and the other of said side panels having a generally centrally disposed groove for joining a multiplicity of sheathed boards together in a tongue-and-groove manner.

6. The wooden bulkhead according to claim 5, wherein each plastic sheath fully encloses its wood board.

* * * * *